United States Patent [19]

Clark

[11] Patent Number: 4,979,238

[45] Date of Patent: Dec. 25, 1990

[54] COMBINATION TOILET SEAT LIFTER AND TOILET FLUSHER

[76] Inventor: Larry E. Clark, 59-541 Ke Iki Rd., Haleiwa, Hi. 96712

[21] Appl. No.: 447,033

[22] Filed: Dec. 7, 1989

[51] Int. Cl.[5] ..... A47K 13/10

[52] U.S. Cl. ..... 4/251; 4/249; 4/661; 16/114 R; 16/116 R; 7/170; 84/177.1

[58] Field of Search ..... 4/250, 251, 253, 661, 4/249; 16/114 R, 116 R, 124; 7/167, 169, 170; 81/177.1, 177.2

[56] References Cited

U.S. PATENT DOCUMENTS

| | | | |
|---|---|---|---|
| 1,064,888 | 6/1913 | Daly | 16/114 R |
| 3,579,664 | 5/1971 | Johnson | 4/250 |
| 3,843,981 | 10/1974 | Verest | 7/170 |
| 4,030,150 | 6/1977 | Fisher | 7/167 R X |
| 4,285,096 | 8/1981 | Swain | 16/114 R |
| 4,839,928 | 6/1989 | Probasco | 4/253 X |

*Primary Examiner*—Charles E. Phillips

[57] ABSTRACT

A combination toilet seat lifter and toilet flusher is disclosed. The combination toilet seat lifter and toilet flusher includes a body portion having a cylindrical shape and further having an open end and a closed end. The body portion contains a longitudinal hollow portion disposed in the open end of the body portion and functioning as a receptacle for the handle flusher. A grip is disposed on the closed end of the body portion and helps to stabilize the combination toilet seat lifter and toilet flusher when in use. A substantially "L"-shaped round tube having a free end and a fixed end. The fixed end is affixed to the body portion and the free end contains a bevel.

4 Claims, 1 Drawing Sheet

COMBINATION TOILET SEAT LIFTER AND TOILET FLUSHER

BACKGROUND OF THE INVENTION

1. Field of the Invention

The present invention relates to a toilet.

More particularly, the present invention relates to a combination toilet seat lifter and toilet flusher.

2. Description of the Prior Art

The U.S. Pat. No. 1,999,555 to Adams teaches a handle fixedly attached to a toilet seat for raising and lowering the toilet seat without the danger of contaminating the user's hands. However, no provision is provided on the handle for holding a deodorant.

The U.S. Pat. No. 2,081,249 to Pryba teaches a counterbalance weight containing a porous deodorizer which is located on a bar a distance from the toilet seat. However, the deodorant is discharged only when the toilet seat is raised or lowered.

The U.S. Pat. No. 2,758,315 to Hylton teaches a commode whose the seat lid can be raised or lowered without the necessity of touching the seat lid with the hands. However, only conventional means are provided for flushing the toilet.

The U.S. Pat. No. 3,783,455 to Vanderbrook teaches a rod fixedly attached to a toilet seat for raising and lowering the toilet seat without the danger of contaminating the user's hands. However, located around the bar is a porous body that soaks up a vaporizing germicide liquid.

The U.S. Pat. No. 4,742,582 to Giallourakis teaches a seat handle for toilets in which one may grab the handle without having to actually touch the toilet seat itself. However, only conventional means are provided for flushing the toilet.

The U.S. Pat. No. 4,805,246 to DeVargas et al. teaches a handle attachable, to the underside of the toilet seat so that the user may readily raise and lower the seat without touching the seat itself. However, only conventional means are provided for flushing.

Numerous innovations for toilet seats have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a combination toilet seat lifter and toilet flusher which avoids the disadvantages of the prior art.

More particularly, it is an object of the combination toilet seat lifter and toilet flusher of the present invention to lift the toilet seat and flush the toilet without direct contact of the hands.

In keeping with these objects, and with others which will become apparent hereinafter, one feature of the present invention resides, briefly stated, in a combination toilet seat lifter and toilet flusher, that comprises: a body portion having a cylindrical shape and further having an open end and a closed end, and a longitudinal hollow portion contained in the open end of the body portion wherein a receptacle for the handle flusher and a grip are provided on the closed end of the body portion and which helps to stabilize the combination toilet seat lifter and toilet flusher when in use and further providing a substantially "L"-shaped round tube having a free end and a fixed end, the fixed end being affixed to the body portion and the free end containing a bevel.

When the combination toilet seat lifter and toilet flusher is designed in accordance with the present invention, a user can operate the toilet seat and the toilet flusher without having to directly touch the toilet seat and/or the toilet flusher with the hands.

In accordance with another feature of the present invention; it further comprises a sanitary container having at least an interior, four sides, and a bottom for storing and carrying the combination toilet seat and toilet flusher.

Another feature of the present invention; is that it further comprises a spongy material that has been soaked in a liquid disinfectant which lines the interior of the sanitary container and including at least the sides and the bottom.

Yet another feature of the present invention is that it; further comprises a lid for keeping the sanitary container closed when storing and/or carrying.

Still another feature of the present invention is that the receptacle receives the flushing handle so that the hands of the user never touch the flushing handle when the toilet is flushed.

Yet still another feature of the present invention is that the area intermediate the cylindrically shaped body portion and the substantially "L"-shaped round tube receives the toilet seat so that the hands of the user never touch the toilet seat when the toilet seat is raised and lowered.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

LIST OF REFERENCE NUMERALS UTILIZED IN THE DRAWING

10—conventional tank toilet

12—flushing handle

Figure 1:
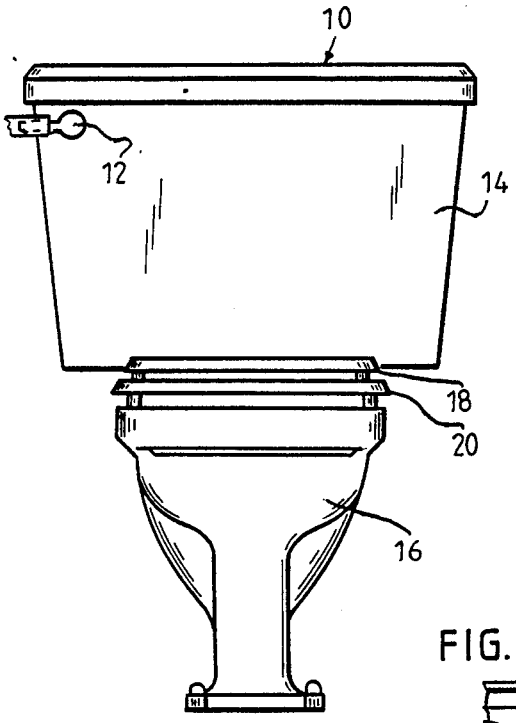
FIG. 1 is a front view of a conventional toilet.

14—water tank
16—toilet bowl
18—toilet bowl cover
20—toilet bowl seat
22—combination toilet seat lifter and toilet flusher
24—body of the combination toilet seat lifter and toilet flusher 22
26—cylindrical container
28—open end of the cylindrical container 26
30—closed end of the cylindrical container 26
32—longitudinal hollow portion
34—receptacle for the handle flusher 12
36—grip of the combination toilet seat lifter and toilet flusher 22
37—"L"-shaped round tube
38—free end of the "L"-shaped round tube 37
40—fixed end of the "L"-shaped round tube 37
42—bevel of the free end 38
44—sanitary container for storing and carrying the combination toilet seat lifter and toilet flusher 22
46—spongy material lining the sanitary container 44
48—lid of the sanitary container 44

DETAILED DESCRIPTION OF THE PREFERRED EMBODIMENT

Referring now to FIG. 1, a conventional tank toilet is shown at 10 and includes a flushing handle 12 for flushing the conventional tank toilet 10, a water tank 14 for storing the flushing liquid, a toilet bowl 16 for receiving the body wastes, a toilet bowl cover 18 for covering the toilet bowl 16, and a toilet bowl seat for the user's convenience. The combination toilet seat lifter and toilet flusher of the present invention is shown in detail generally at 22 in FIGS. 2 2A and 2B.

The combination toilet seat lifter and toilet flusher 22 includes a body 24 which is a cylindrical container 26 having an open end 28 and a closed end 30, a longitudinal hollow portion 32 is contained in the open end 28 and which functions as a receptacle for the handle flusher 12.

The combination toilet seat lifter and toilet flusher 22 further includes a grip 36 disposed at the closed end 30 of the body 24 and which helps stabilize the combination toilet seat lifter and toilet flusher 22 when in use.

A substantially "L"-shaped round tube 37 having a free end 38 and a fixed end 40. The fixed end 40 is affixed to the body 24 while the free end 38 has a bevel 42.

Figure 2A:
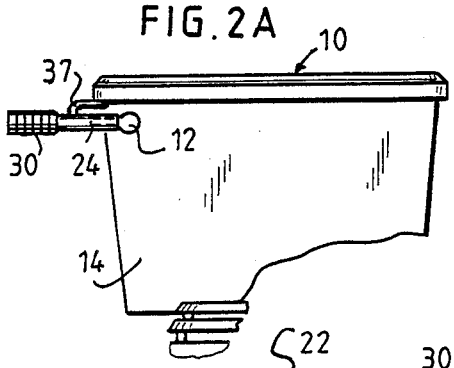
FIG. 2A is a partial front view of the toilet seat lifter and toilet flusher of the present invention being used to flush a conventional toilet, as shown in FIG. 1.
Figure 2:
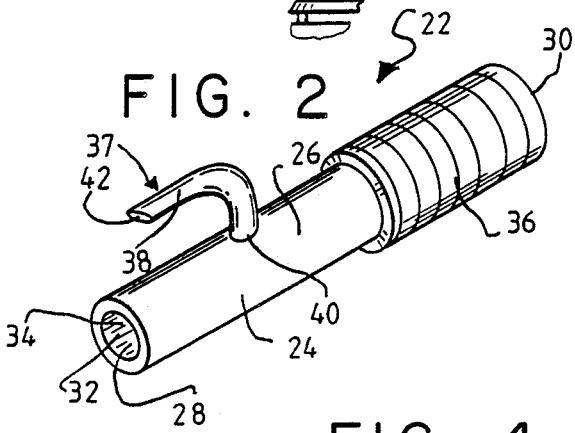
FIG. 2 is a perspective view of the combination toilet seat lifter and toilet flusher of the present invention.

As shown in FIG. 2A, in operation, the present invention 22 is being used as a toilet flusher, wherein the flushing handle 12 of the conventional toilet 10 is readily removably slid within the body 24. The grip 36 is pushed down and the toilet flushes, as normal. The present invention 22 may either be left on the flushing handle 12 or removed by merely sliding it off the flushing handle 12.

Figure 2B:
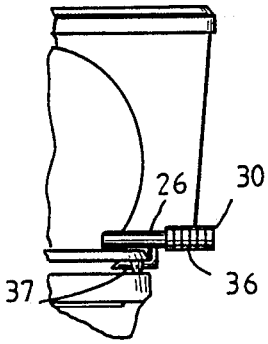
FIG. 2B is a partial front view of the toilet seat lifter and toilet flusher of the present invention being used to raise and lower a conventional toilet seat, as shown in FIG. 1.
Figure 4:
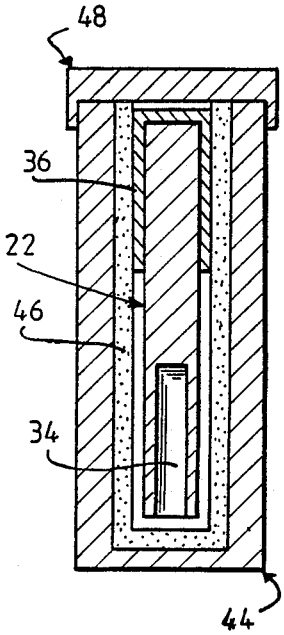
FIG. 4 is a side cross-sectional view of the combination toilet seat lifter and toilet flusher of the present invention, taken along line 4—4 in FIG. 3.

As shown in FIG. 2B, in operation, the present invention 22 is being used to raise and/or lower a toilet seat 20 and/or toilet cover 18, wherein the toilet seat 20 and/or toilet cover 18, of the conventional toilet 10, is readily removably disposed intermediate the body 24 and the "L"-shaped round tube 37. The "L"-shaped round tube 37 is readily removably slid under the toilet seat 20 and/or toilet cover 18. The grip 36 is then either raised or lowered depending upon the desired position for the toilet seat 20 and/or toilet cover 18. The present invention 22 is then removed by merely sliding it off the toilet seat 20 and/or toilet cover 18.

Figure 3:
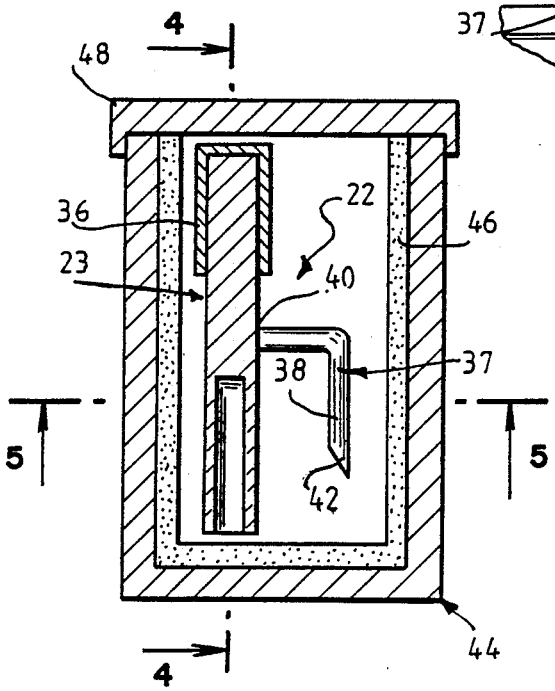
FIG. 3 is a front cross-sectional view of the combination toilet seat lifter and toilet flusher of the present invention, shown in a closed receptacle containing a disinfectant so that the combination toilet seat lifter and toilet flusher can be stored and carried in a germ free environment.
Figure 5:
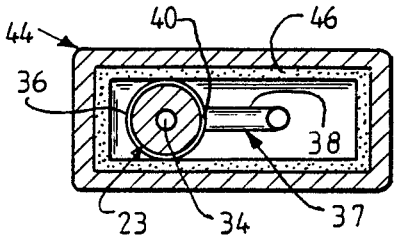
FIG. 5 is a top cross-sectional view of the combination toilet seat lifter and toilet flusher of the present invention, taken along line 5—5 in FIG. 3.

FIG. 3 shows a sanitary container 44 for storing the combination toilet seat lifter and toilet flusher 22. The sanitary container 44 contains a spongy material 46 that has been soaked in a liquid disinfectant, that lines the interior of the sanitary container 44 on at least the sides and on the bottom. The lid 48 keeps the sanitary container 44 closed when storing, carrying, etc.

In FIGS. 2A, 2B, 3, 4, and 5, the combination toilet seat lifter and toilet flusher 22 of the present invention is shown from three different directions. The combination toilet seat lifter and toilet flusher 22 fits quite nicely in the sanitary container 44 with its disinfectant lined sponge material 46.

In operation, the lid 48 is removed from the sanitary container 44. The combination toilet seat lifter and toilet flusher 22 of the present invention is lifted, by the grip 36, out of the sanitary container 44 that contains the liquid disinfectant. The grip 36 allows the user to obtain a more better grasp on the present invention. The combination toilet seat lifter and toilet flusher 22 is then washed off and is again ready for use.

In use, the combination toilet seat lifter and toilet flusher 22 can flush the toilet, lift the toilet cover and/or toilet seat without the user having to touch the toilet proper with his hands in order to accomplish the desired result.

With the present invention the user merely moves the combination toilet seat lifter and toilet flusher 22 into position in which the toilet seat 20 and/or cover 18 is disposed between the body 24 and the "L"- shaped round tube 37 of the present invention.

Now that the combination toilet seat lifter and toilet flusher 22 is in position, the combination toilet seat lifter and toilet flusher 22 is lifted and the toilet cover and/or toilet seat lifts with the combination toilet seat lifter and toilet flusher 22 so that the hands of the user never touch the toilet cover 18 and/or seat 20.

Additionally, the user merely moves the combination toilet seat lifter and toilet flusher 22 into position in which the flushing handle 12 enters the receptacle 34 of the handle flusher 12. Now that the combination toilet seat lifter and toilet flusher 22 is in position, the combination toilet seat lifter and toilet flusher 22 is pushed down. The flush handle 12 moves with the receptacle 34 so that the hands of the user never touch the flushing handle 12.

It will be understood that each of the elements described above, or two or more together, may also find a useful application in other types of constructions differing from the type described above.

While the invention has been illustrated and described as embodied in a combination toilet seat lifter and toilet flusher, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A combination toilet seat lifter and toilet flusher, comprising:

(a) a body portion having a cylindrical shape and further having an open end and a closed end, said body portion containing a longitudinal hollow portion contained within said open end of said body portion and functioning as a receptacle for a toilet handle flusher;

(b) a grip disposed on said closed end of said body portion which helps to stabilize the combination toilet seat lifter and toilet flusher when in use;

(c) a substantially "L"-shaped round tube having a free end and a fixed end, said fixed end being affixed to said body portion and said free end containing a bevel;

(d) a sanitary container at least having an interior, four sides, and a bottom, and used for storing and carrying the combination toilet seat lifer and toilet flusher; and (e) a spongy material that has been soaked in a liquid disinfectant which lines said interior of said sanitary container and including at least said sides and said bottom.

2. A toilet as defined in claim 1; further comprising a lid for keeping said sanitary container closed when storing and carrying the combination toilet seat and toilet flusher.

3. A toilet as defined in claim 2, wherein said receptacle receives the flushing handle so that the hands of the user never touch the flushing handle when the toilet is flushed.

4. A toilet as defined in claim 3, wherein the area intermediate said cylindrically shaped body portion and said substantially "L"-shaped round tube receives said toilet seat so that the hands of the user never touch the toilet seat when the toilet seat is raised and lowered.

* * * * *